US006302282B1

(12) United States Patent
Gay et al.

(10) Patent No.: US 6,302,282 B1
(45) Date of Patent: Oct. 16, 2001

(54) OPEN FRAME SHELF ASSEMBLY

(76) Inventors: Kenneth F. Gay, 241 Apache St., Westerville, OH (US) 43081; Kenneth R. Gay, 588 Haddler Ct., Dublin, OH (US) 43017

( * ) Notice: Subject to any disclaimer, the term of this patent is extended or adjusted under 35 U.S.C. 154(b) by 0 days.

(21) Appl. No.: 09/058,402

(22) Filed: Apr. 9, 1998

(51) Int. Cl.[7] ..... A47F 5/08

(52) U.S. Cl. ..... 211/153; 211/150; 248/242; 108/6; 108/152

(58) Field of Search ..... 211/153, 150; 248/235, 242, 241, 243; 108/6, 8, 152

(56) References Cited

U.S. PATENT DOCUMENTS

| | | | | |
|---|---|---|---|---|
| 942,965 | * | 12/1909 | Kramer | 248/242 X |
| 945,280 | | 1/1910 | Lindberg . | |
| 1,440,883 | * | 1/1923 | Millice | 211/184 |
| 1,915,371 | * | 6/1933 | Lowman | 248/242 X |
| 2,949,323 | * | 8/1960 | Moorhead | 211/169 X |
| 3,080,980 | * | 3/1963 | Gibbons | 248/242 X |
| 3,082,986 | * | 3/1963 | Campanizzi | 248/242 X |
| 3,151,576 | | 10/1964 | Patterson . | |
| 3,417,872 | | 12/1968 | Close . | |
| 3,426,993 | | 2/1969 | Johansson . | |
| 3,490,600 | * | 1/1970 | Reed et al. | 211/59 |
| 3,508,665 | * | 4/1970 | Goldstein et al. | 211/150 X |
| 3,550,891 | | 12/1970 | Scott . | |
| 3,561,713 | * | 2/1971 | Berkowitz | 248/242 |
| 3,665,377 | * | 5/1972 | MacKenzie, Jr. | 211/150 X |
| 3,795,379 | | 3/1974 | Gray . | |
| 4,065,088 | * | 12/1977 | Shell | 248/242 |
| 4,098,480 | * | 7/1978 | Neumann | 248/242 X |
| 4,350,098 | | 9/1982 | Shirono et al. . | |
| 4,552,272 | | 11/1985 | Field . | |
| 4,730,738 | * | 3/1988 | Bartus et al. | 248/242 X |
| 4,934,645 | | 6/1990 | Breslow . | |
| 5,738,019 | * | 4/1998 | Parker | 108/108 |

* cited by examiner

*Primary Examiner*—Daniel P. Stodola
*Assistant Examiner*—Khoa Tran
(74) *Attorney, Agent, or Firm*—Mueller and Smith, EPA

(57) ABSTRACT

An open frame display shelf assembly formed of elongate parallel base rods to which are connected an array of rod beams arranged transversely to the base rods and bent upwardly to support forward and rearward wall-forming rods. The wall-forming rods are arranged to provide receptor gaps. The shelves are supported from cantilevered sidewalls also containing receptor gaps. A bracket assembly with two adjusting components and three triangularly oriented connectors permit attitude adjustments of the shelf. A sign mount at the forward walls of the shelving is tiltable to accommodate the attitude of the shelf assembly.

7 Claims, 9 Drawing Sheets

80c
80b
196c
210b
194c
212b
178c
176b
114c
146b
182c
208b
284
292
186d
149b
287
149d
186a
290
208d
182a
146d
114a
176d
178a
212d
192a
210d
194a
80d
80a

OPEN FRAME SHELF ASSEMBLY

CROSS-REFERENCE TO RELATED APPLICATIONS

None.

STATEMENT REGARDING FEDERALLY SPONSORED RESEARCH

Not applicable.

BACKGROUND OF THE INVENTION

Shelving is widely employed in the retail merchandising of products. Where merchandise is both stacked and displayed on shelves for direct access by the customer, a number of design considerations for the display technique come to bear. The shelving should be both aesthetically pleasing and exhibit an openness permitting both a desirable customer visualization of the product and an open ease of manual access to it. Such criteria usually call for a cantilevered structure extending to an aisle from upstanding mounts located at each end of a display bay. Very often, the products supported for display, collectively, are relatively heavy. For instance, caulking gun refills, paints, and the like can require a shelf structural capability for retaining about 400 pounds worth of merchandise. Such requirements have in the past led to solid shelf structures evidencing quite robust structuring with size and bulk militating against desirable aspects of customer access and the aesthetics of customer visualization.

Because consumer demand for products generally varies with time and the products displayed by merchants change, it is preferable that display shelving system have a modularity to it. The shelves, for the most part, are mounted using a hook or notch plate and slot connector structure, the slots being formed in standards which, in turn, are either mounted upon a store wall or upon aisle defining supports which are either L-shaped or have the shape of inverted T. In the retail trade, the aisle defining shelf and support systems are referred to as "gondolas".

In addition to being aesthetically pleasing and capable of carrying substantial loads, retailers also prefer that display shelving be relatively light in weight in and of itself, inasmuch as store personnel very often are called upon to move them about, adjust shelf heights and the like. For some displays, it is particularly desirable that some form of tilt downwardly or upwardly from horizontal, i.e. a sloping attitude be made available. In such an arrangement, the display can be made more visual to the customer and a feed forward form of stacking of product becomes more simply provided. Such attitude or tilt adjustment calls for some form of pivoting structure at the rear of the shelves, and robust tiltable structures generally defeat the aesthetic attributes of the shelving because of the large forces imposed on their components such as bolts which permit pivotal adjustment at the rear of the shelf.

Associated with essentially all shelving displays is a requirement for signage at the front of the shelves. Generally, the signage is provided at the front edge of the shelf where it may be difficult for the customer to read. This particularly holds true where the shelves are canted downwardly and the edge signs cannot be tilted upwardly for customer visualization. Such situation also holds true for shelves at higher levels where vertical signage must be read at a visual angle from the customer's eye station.

BRIEF SUMMARY OF THE INVENTION

The present invention is addressed to an improved, open frame display shelf assembly which is configured for use with conventional, pre-existing shelf supports or gondolas. A salient feature of the shelves is a bracket assembly which permits facila tilting or changing of the attitude of the shelves, while remaining unobtrusive due to its compact size. Notwithstanding its compact size, the bracket assembly is structurally robust, importantly due to a geometry featuring three connectors provided as steel bolts and arranged in a triangular pattern. These connectors include a pivot bolt and two outboard bolts located within arcuately disposed apertures spaced a predetermined radius away from the center of the pivot bolt. The outboard connector bolts are angularly spaced apart a predetermined and mandated angle with respect to the position of the pivot bolt. This is achieved through the use of two, sheet steel bracket adjusting components, one of which is fixed to a sidewall of the open frame shelving and the other of which incorporates two conventional notch plates or hooks which are inserted within the slots of a conventional supporting standard. The pivot bolt connects these two adjusting components in a pivoting relationship. One component is formed having one or more arrays of attitude defining apertures regularly spaced along arcuate loci. Such aperture spacing corresponds with a predetermined radially defined angle with respect to the pivot bolt. The second adjusting component is formed with one or more arrays of pairs of apertures, those paired apertures being located at radii which are angularly separated by the predetermined and mandated angle, for example 18°. Store personnel who adjust the amount of tilt or attitude of the shelves can insert the outboard connector bolts only through aligned apertures located at the mandated angle of spacing. All other apertures of the two adjusting components will be blocked. Thus, the structural integrity of this tri-strut bracket assembly geometry is assured without resort to written instructions, labels or the like describing necessary outboard connector bolt positioning.

The open frame shelf assemblies each are formed with walls positioned at each of the four sides. These walls are configured having receptor slots into which merchandise retaining components such as U-shaped guideways and the like may be inserted. The receptor gaps are accessible from either side of the shelves. In this regard, the shelves may be mounted with the sidewalls facing downwardly or upwardly at the desire of the user. To provide for this reversible arrangement, one adjusting component, that carrying the hooks, is switched from one side of the shelf to the other.

The shelving assembly also features a sign mount which is connectable with the forward wall and which contains two couplers and a sign engaging surface. The entire mount may be rotated or tilted in correspondence with the tilt or attitude of the shelf itself. Thus, the tilting signage may be provided to accommodate low or high positioned shelves as well as shelves which have been tilted either upwardly or downwardly.

Other objects of the invention will, in part, be obvious and will, in part, appear hereinafter. The invention, accordingly, comprises the system and apparatus possessing the construction, combination of elements, and arrangement of parts which are exemplified in the following detailed description.

DETAILED DESCRIPTION OF THE INVENTION

Figure 1:
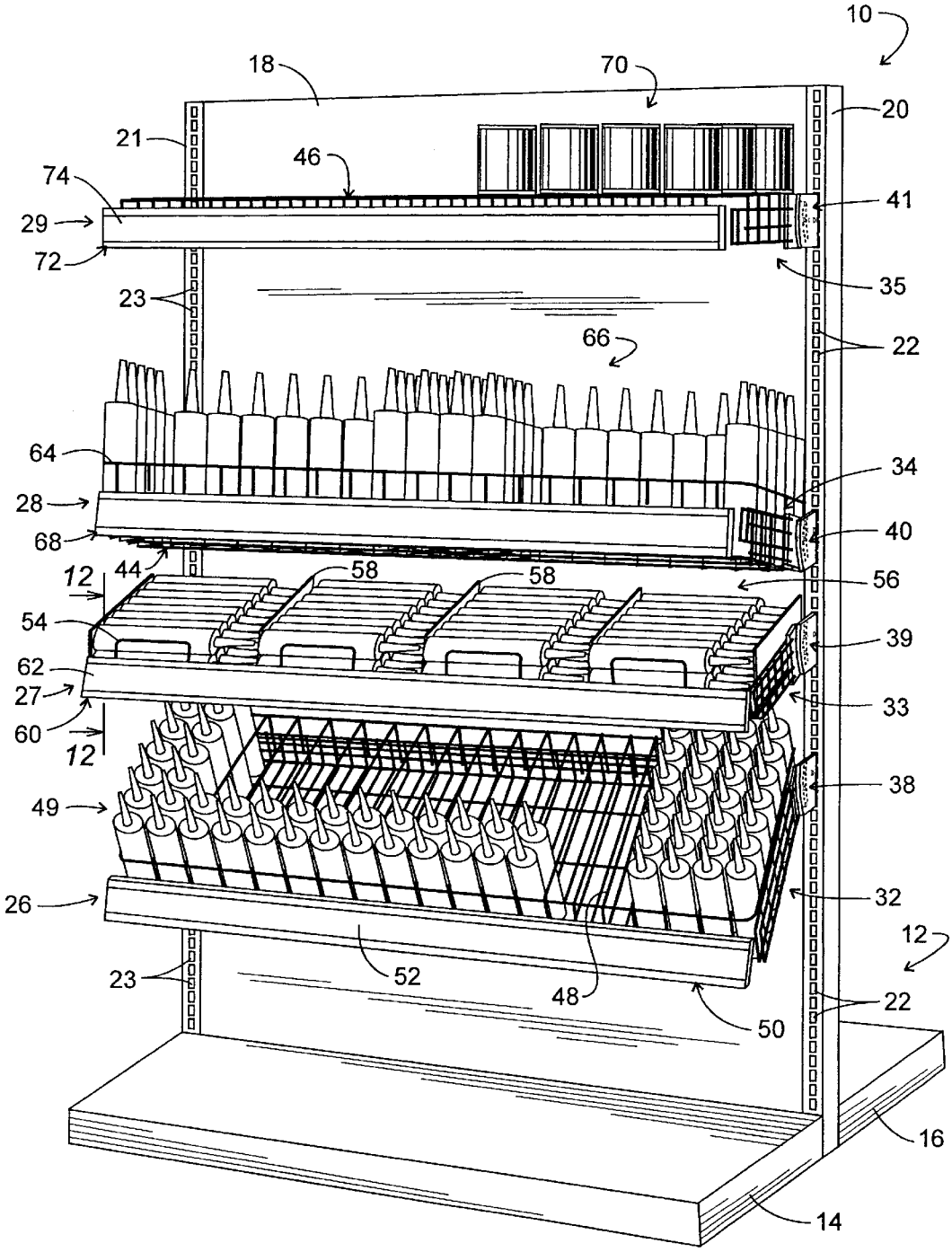
FIG. 1 is a perspective view of a merchandise display system incorporating the display shelving assembly of the invention.

Referring to FIG. 1, a merchandise display system incorporating the display shelf assemblies of the invention is revealed generally at 10. The system 10 includes a conventional shelf support structure represented generally at 12 which is sometimes referred to in the retail trade as a "gondola". The version illustrated is in the form of an inverted "T" having floor supported feet or base members 14 and 16, which, in turn, support a centrally disposed back wall 18. Back wall 18, in turn, incorporates two vertical shelf supports or standards 20 and 21 which are spaced apart a distance which may be termed a bay width. Standards 20 and 21 are configured having a sequence of slightly elongate, vertically disposed slots, certain of which are shown, respectively, at 22 and 23.

Four open frame display shelf assemblies according to the invention are seen mounted upon the shelf support structure 12 as represented generally at 26–29. Shelves 26–29 are comformed with the same basic structuring, each being formed with oppositely disposed open frame sidewalls, one of which is seen, respectively, at 32–35. The sidewalls are supported from the standards 20 and 21 through utilization of pivotal bracket assemblies which, for sidewalls 32–35 are seen at 38–41. The bracket assemblies 38–41 incorporate hooks or notch plate components which function to engage the slots 22 of standard 20.

The sidewalls 32–35 and their counterparts coupled to standard 21 support the remainder of each of the shelf structures including a base or base region which may be observed generally in connection with shelf assembly 28. These base regions of the shelves extend to a forward wall and a rearward wall, again fashioned in open frame manner. The bracket assemblies as at 38–41 and their counterparts on the opposite side of the shelves permit shelf mounting in a relatively broad range of orientations. For example, shelf assembly 26 is seen to be mounted at a relatively steep downward attitude or slope and incorporates a plurality of parallel, generally D-shaped merchandise guideways represented generally at 48 and which are seen to provide a feed forward arrangement for merchandise represented as caulk gun refills. Such merchandise guideways will be seen to be removably insertable within forward and rearward receptor gaps which are formed, respectively, in the forward and rearward walls of the shelf assembly. Shelf assembly 26 also is seen to incorporate an elongate sign mount represented generally at 50 having upper and lower channels which slideably secure thin signs as represented at 52. Note that the sign 52 is held in an orientation wherein it is rotated upwardly at the forward wall of shelf assembly 26 to compensate for the extent of downward slope of the shelf. Thus, customers passing before the display system 10 readily can observe the information presented by the signage.

Looking to shelf assembly 27, note that its attitude or downward slope has been adjusted at the bracket assemblies as at 39 such that a lesser slope is developed. Inserted in a receptor gap at the forward wall of the shelf assembly 27 are D-shaped merchandise retaining loops, one of which is represented at 54. The merchandise, represented as horizontally disposed caulking gun refills shown generally at 56 also are spaced apart by L-shaped polymeric separators as represented, for example, at 58. It may be observed that for the downwardly-slopeing shelve assemblies as at 26 and 27, in addition to the development of a simple feed forward arrangement, the shelves permit an improved view of the merchandise displayed therein to the customer. In similar fashion as shelf 26, shelf 27 also incorporates a sign mount represented generally at 60 and structured identically with that shown at 50 in connection with shelf assembly 26. Accordingly, the shelf mount 60 may support a thin sign, 62. Note, however, that the angle at which mount 60 is adjusted is of lesser extent than that shown with respect to mount 50. This accommodates for the slightly higher elevation of the shelf assembly 27.

Shelf assembly 28 demonstrates that the adjustment available with bracket assemblies as at 40 and its opposite side counterpart may provide an oppositely disposed slope, here shown as a slight upward slopee or attitude. As in the case of shelf assembly 26, shelf assembly 28 incorporates a merchandise guide assembly represented generally at 64. Guide assembly 64 employed with merchandise 66 may or may not incorporate guideways extending from the front wall to the rear wall, however, as before, the guideways are insertable within receptor gaps that are configured in all four sidewalls, i.e. the front, back, and two sides. A sign mount represented generally at 68 for the shelf assembly 28 may be retained in a vertical position or slightly canted upwardly or downwardly depending upon the elevation of the shelf 28 and its merchandise.

The modularity of the shelving assemblies further is demonstrated in connection with shelving assembly 29 wherein it is turned upside down as compared with shelving assemblies 26–28. This inverts the basket-forming upstanding side, back, and forward walls to provide downwardly directed walls. The assembly 29 is shown retained by bracket assembly 41 and its counterpart at the opposite side in a generally horizontal orientation, however, it may be adjusted to an attitude tilting either upwardly or downwardly. Additionally, receptor gaps at all four shelf sides remain accessible for the insertion of guideways and the like. The orientation of shelf assembly 29 is achieved by the simple expedient of reversing and switching one bolted-on pivoting component of the bracket assembly. Merchandise is shown at 70 in supported upon base 46. The forward wall of shelf assembly 29 supports a sign mount represented generally at 72 which, in turn, retains a thin sign 74. As in the case of sign mounts 50, 60, and 68, the sign mount 72 is capable of tilting the orientation of sign 74 either upwardly or downwardly. Typically, for shelf assemblies at higher elevations, the signs are tilted slightly downwardly to aid customer readability.

Figure 2:
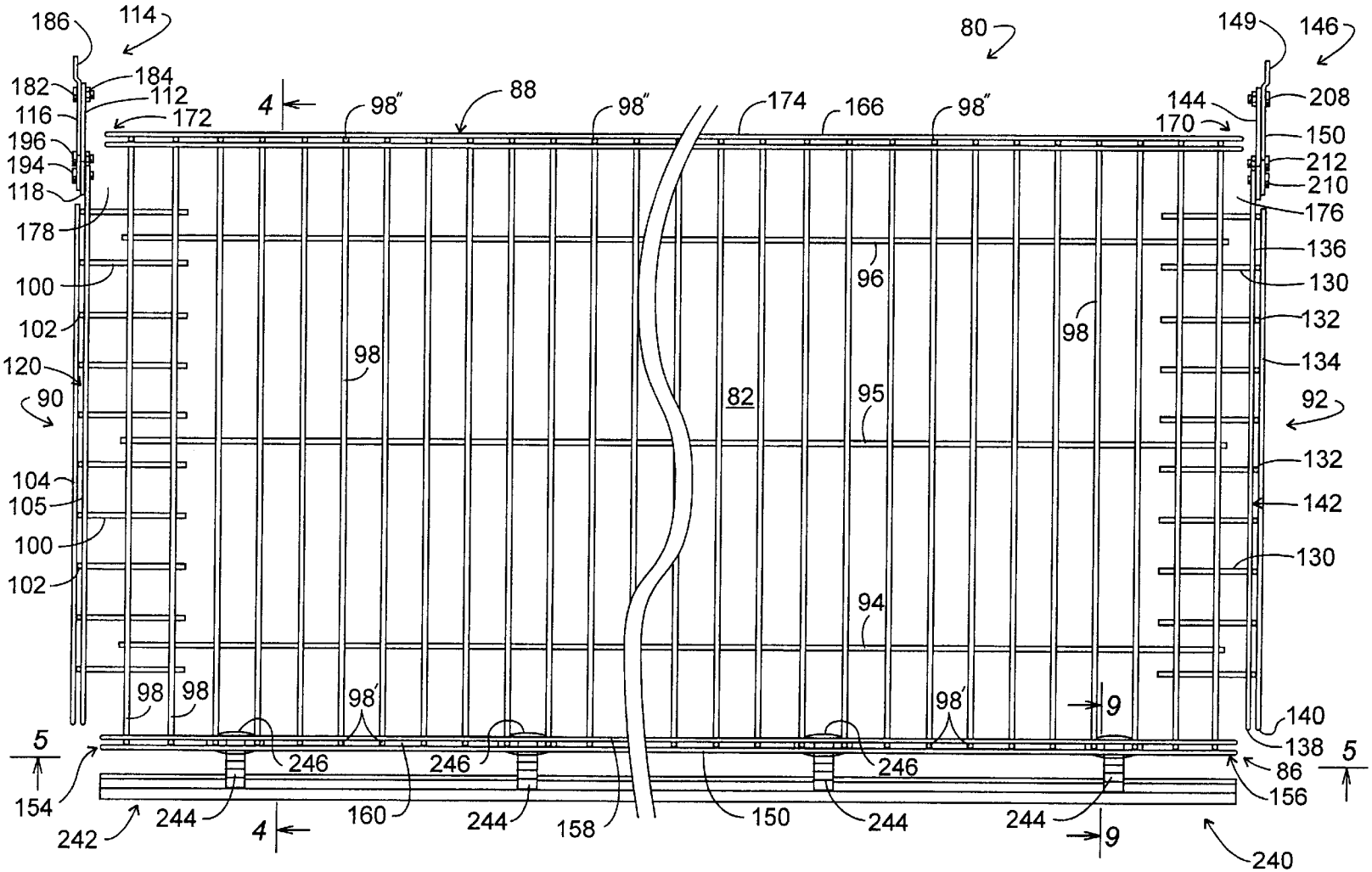
FIG. 2 is a top view of an open frame display shelving assembly according to the invention.

Referring to FIG. 2, a shelf assembly is represented generally at 80. The assembly 80 has a base region or surface represented generally at 82 which in either orientation of the shelf as demonstrated in connection with FIG. 1 comparing shelf assemblies 26–28 with shelf assembly 29, functions to support merchandise. The base region 82 forms the bottom of a shallow wide U-shaped configuration, extending from a forward wall represented generally at 86 at a forward region to a rearward wall represented generally at 88 located at a rearward region. Base 82 and its associated forward wall 86 and rearward wall 88 is supported in cantilever fashion by two sidewalls or sidewall regions represented generally at 90 and 92. The structure of the base 82 includes three spaced-apart parallel elongate base rods having a lengthwise extent corresponding with a bay width, thus extending between the side regions 90 and 92. These base rods are shown at 94–96. Positioned upon and welded to the base rods 94–96 is an array of rod beams, certain of which are represented at 98. Rod beams 98 of the array are arranged transversely to the base rods 94–96, and are positioned in parallel, mutually spaced relationship a distance selected to provide the noted base or surface 82. The center-to-center spacing between the rod beams 98 may, for example, be one inch for a typical shelf assembly. All of the rods 98 are bent upwardly in the sense of FIG. 2 to provide forward extensions, certain of which are seen at 98', which are part of the structure of forward wall 86. In similar fashion, the beam rods 98 are bent upwardly to provide rearward extensions, certain of which are represented at 98". The extensions 98' and 98" have a length for establishing the height of the respective forward wall 86 and rearward wall 88.

Figure 3:
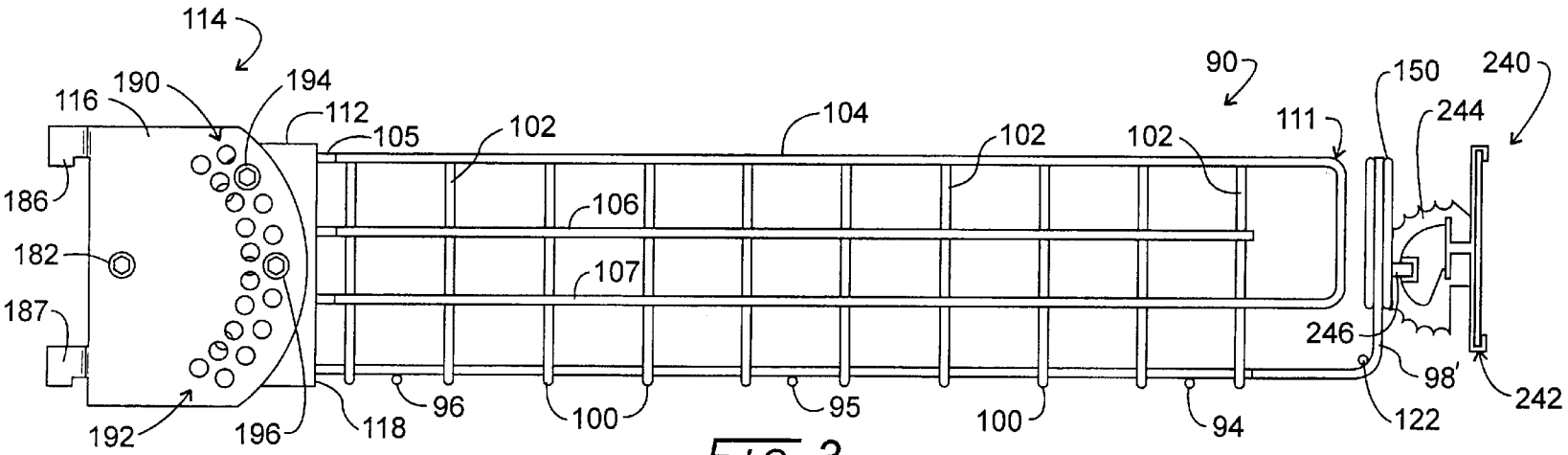
FIG. 3 is a left side view of the display shelving assembly of FIG. 2.
Figure 4:
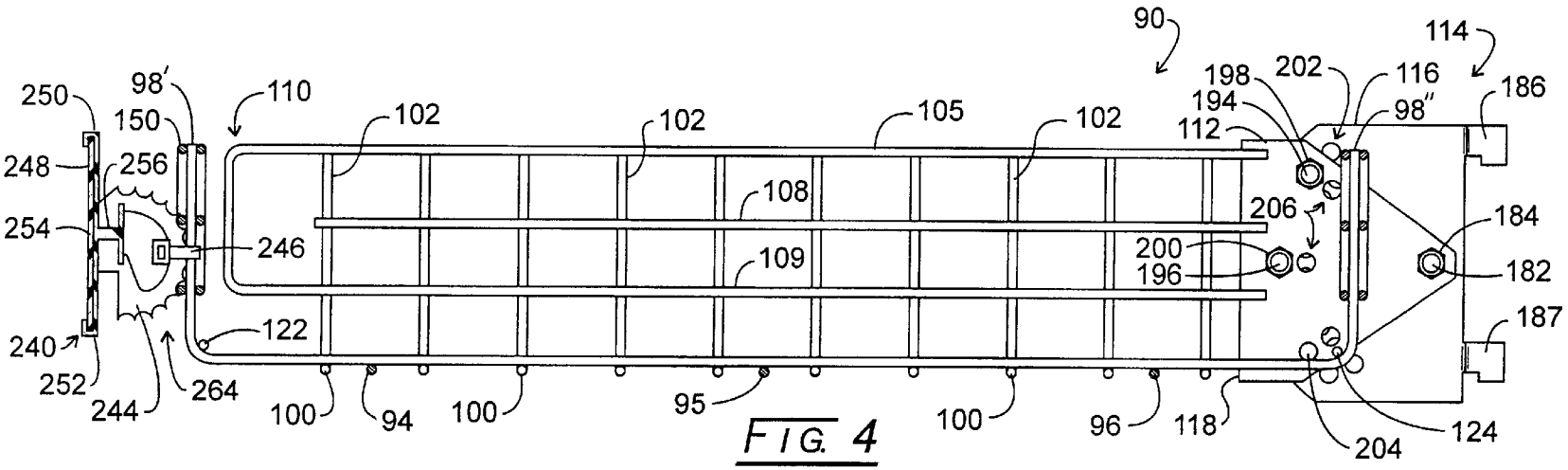
FIG. 4 is a sectional view taken through the plane 4—4 in FIG. 2.

Sidewalls 90 and 92 are structured substantially identically, a right and left reverse sense being the only difference between them. Accordingly, the discourse turns to the examination of sidewall 92. Sidewall 92 and sidewall 90 is configured to support the base region 82 and associated forward wall 86 and rearward wall 88 in cantilever fashion from upright supports as at 20 and 21. Note that the sidewall 90 incorporates an array of side load transfer rods, certain of which are identified at 100. Rods 100 are arranged in spaced-apart mutually parallel adjacency, and are fixed by welding to the outside pair of rod beams 98. Load transfer rods 100 are bent upwardly in the sense of FIG. 2 to form sidewall extensions, certain of which are represented at 102, which are arranged normally or perpendicularly to the open frame base or surface 82. Welded to the sidewall extensions 102 are a plurality of sidewall forming rods, the uppermost ones of which are seen in FIG. 2 at 104 and 105. Rods 104 and 105 as well as all of the sidewall forming rods may be observed to be parallel to the beam rods 98. Looking additionally to FIG. 3, the outside of sidewall 90 is shown to incorporate two additional sidewall forming rods 106 and 107. Rods 106 and 104 are formed as a parallelogramic loop having a forward loop end 111. These rods extend to adjacency with the inwardly-disposed adjusting component 112 of a bracket assembly represented generally at 114. The outer adjusting component of the bracket assembly 114 is shown at 116. Looking additionally to FIG. 4, the opposite side of sidewall 90 is revealed. In this regard, interior sidewall forming rod 105 reappears in conjunction with sidewall forming rods 108 and 109. Rods 105 and 109 are configured as a parallelogramic loop with a forward loop end 110. Note that the sidewall-forming rods on either side of the sidewall extensions 102 of side load transfer rods 100 are aligned both vertically and horizontally. Sidewall forming rods 105, 108, and 109 are fixed by welding to the adjusting component 112 of bracket 114 adjacent its forward edge 118. With the welded attachment of the sidewall-forming rods 104, 106, and 107 at one side of the array of extensions 102 and the corresponding aligned connection of sidewall forming rods 105, 108, and 109 on the other side of the sidewall extensions, a receptor gap is formed. Returning to FIG. 2, this receptor gap is seen at 120. This gap 120 provides for the insertion and support of such implements as the merchandise guideway assemblies 48 and 64 described in connection with FIG. 1. FIG. 4 additionally reveals the provision of two interiorly disposed elongate base rods 122 and 124 which are welded over the rod beams 98 at the bends thereof providing for upward extensions. In this regard, base rod 122 is located at the bend of forward extension 98' of the rod beams and base rod 124 is located at the bend of the rearward extension 98" of the rod beam array. Rod 122 also appears in FIG. 3. These rods will be seen to be aligned with wall forming rods of the forward and rearward walls, thus to permit the development of receptor gaps at those walls which may be used with the shelving assemblies in a basket-like sense or inverted sense as discussed in connection with FIG. 1.

FIG. 2 reveals the corresponding sidewall structure 92 to be formed with an array of side load transfer rods, certain of which are revealed at 130. Load transfer rods 130 are weldably connected to the underside of the outer pair of rod beams 98. These rods 130 are bent upwardly normally to the base surface 82 to provide sidewall extensions, certain of which are revealed at 132. Three sidewall-forming rods are welded to the outside of the extensions 132, the uppermost one of which is seen at 134. Those sidewall-forming rods, the uppermost one of which is shown at 134, correspond with rods 104, 106, and 107 described in connection with FIG. 3. On the inner side of the sidewall extensions 132, additional sidewall forming rods are provided, the uppermost one being represented at 136. These sidewall rods correspond with those described at 105, 108, and 109 in FIG. 4. As discussed in connection with FIGS. 3 and 4, two of the sidewall forming rods are configured as a parallelogramic loop having a forward loop end at the forward region of the display assembly. Those loop ends are shown in FIG. 2 at 138 and 140. With the arrangement, a receptor gap 142 is developed at the sidewall 92. The interiorly disposed sidewall forming rods, the upper one of which is shown at 136 are weldably connected to the interiorly-disposed adjusting component 144 of bracket assembly 146, the outer adjusting component being represented at 150. The components of bracket assembly 146 are structured identically as that at 114.

Figure 5:
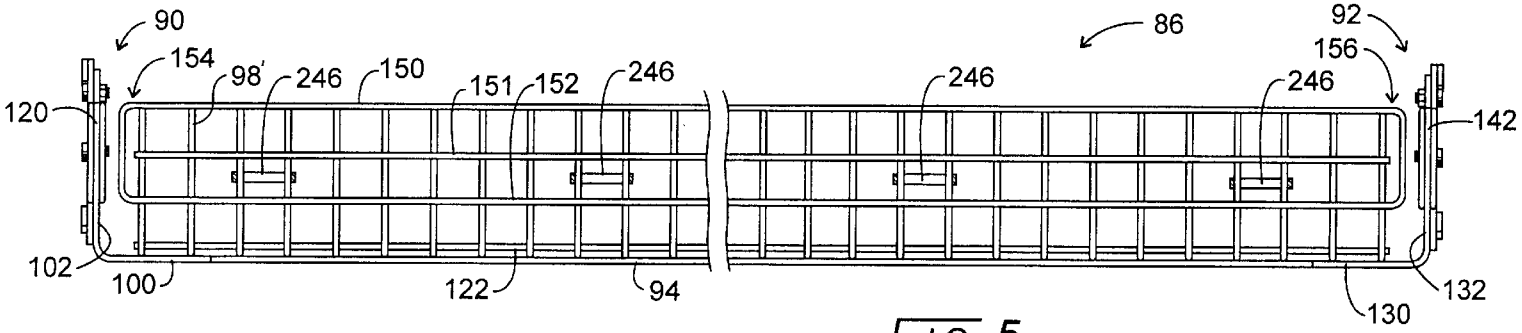
FIG. 5 is a sectional view taken through the plane 5—5 in FIG. 2.

Forward wall 86 incorporates a similar wall forming rod arrangement as sidewalls 90 and 92. Looking to FIG. 5, the forward extensions 98' of rod beams 98 are seen to extend upwardly a wall height from their bend located attachment with interiorly disposed elongate base rod 122. Note, in the figure, that the elongate base rods within base region 82 extend below the rod beams 98, base rod 94 being observable in the figure. Forward wall 86 is fashioned utilizing forward wall forming rods which are welded to each side of the forward extensions 98' and extend laterally across the assembly. Forward wall 86 includes a plurality of oppositely disposed elongate forward wall forming rods arranged in parallel relationship with the base rods 94–96. FIG. 5 reveals the forwardly-disposed ones of these rods at 150–152. Of these components, wall forming rods 150 and 152 are configured as a parallelogramic loop having loop ends at 154 and 156. A corresponding grouping of three forward wall-forming rods are positioned on the opposite sides of the rod beam forward extensions 98' . The top one of these rods is seen in FIG. 2 at 158 and the loop ends thereof fall in alignment with those at 154 and 156. With this arrangement, the forward receptor gap as seen in FIG. 2 at 160 is provided. It may be observed in FIG. 2 that this gap extends entirely through the forward wall 86 such that implements can be attached to the assembly 80 at this gap 160 from either the top or the bottom side to accommodate for the opposite orientations seen in FIG. 2.

Figure 6:
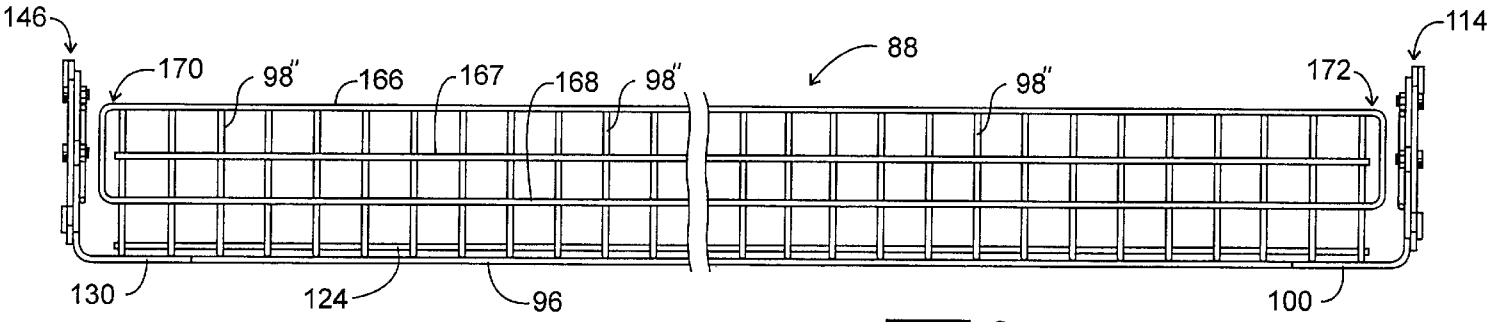
FIG. 6 is a rear view of the display shelf assembly of FIG. 2.

Referring to FIGS. 2 and 6, the structuring of the rearward wall 88 is revealed. In the figure, the rearward extensions of the rod beams 98 are shown at 98" extending upwardly a wall height distance. Outer base bar 96 is seen in the figure along with internally disposed elongate base rod 124. Wall 88 is configured with a plurality of rearward wall forming rods fixed to the extensions 98" at either side thereof, the rods being in mutual horizontal alignment. Three such rearward wall forming rods are seen in FIG. 6 at 166–168. Of these rods, wall forming rods 166 and 168 are configured as a parallelogramic loop with end loops at 170 and 172. Three identical rearward wall forming rods are located on the opposite side of the rearward extensions 98", the top one of which is seen at 174 in FIG. 2. Rod 174 forms the top portion of a parallelogramic loop with loop ends immediately behind those 170 and 172. Note that these loop ends are spaced inwardly from the inward surface of the adjusting component or plates 112 and 144 of respective brackets 114 and 146. This provides respective access gaps 176 and 178 which facilitate user access to the bolts or connectors utilized in adjusting the attitude of the shelf assemblies 80.

Returning to FIGS. 3 and 4, connectors or bolts as are associated with bracket 114 are further considered. In FIG. 3, it may be observed that the outwardly-disposed adjusting component 116 is configured having a bolt 182 with a low profile head extending through an aperture formed within it and thence into a corresponding pivot aperture within rearwardly disposed adjusting component 112. This provides a pivoting connection. The nut completing this connection is shown in FIG. 4 at 184 as having been tightened down against the adjusting component 112. As is apparent, the component 112 is positioned in slideable adjacency with adjusting component 116 and is substantially flat, being formed of sheet steel. Each of the figures shows that the outwardly disposed adjusting component or plate 116 is formed having outwardly offset notch plates or hook-like protrusions 186 and 187 which are vertically spaced apart and configured for insertion within correspondingly spaced slots 22 or 23 of the respective standards 20 and 21 (FIG. 1). FIG. 3 reveals that adjusting component 116 is formed having an outer array 190 of attitude defining apertures which are regularly spaced along an arcuate locus and inwardly disposed therefrom toward the pivot connector 182 is another array of attitude defining apertures represented generally at 192 extending along a locus represented by a radius of lesser extent than that extending to the locus represented by the array of apertures 190. In a preferred arrangement of the invention, the apertures within array 190 are symmetrical about adjacent radii from the pivot connector 182 and, similarly, the apertures within array 192 are positioned symmetrically about radii having the same angular separation. Holding the shelf assembly in the horizontal orientation shown with respect to the pivot connector 182 are bolt-type connectors 194 and 196 which function to provide a tri-strut form of structural retention. In particular, the radial spacing of the apertures of the arrays 190 and 192 is about 6° and note that the apertures of array 192 are interdigitated with respect to those at array 190. The angular relationship of connectors 194 and 196 with respect to pivot connector 182 is about 18° or three times the base angular spacing of the apertures of each of the arrays 190 and 192.

FIG. 4 reveals that connectors 194 and 196 are retained in place by respective nuts 198 and 200. As is apparent from this figure, adjusting component 112 is formed having an outer array 202 of pairs of connectors, one pair of which is shown receiving the connectors 194 and 196. A second pair of that array will include the aperture within which connector 196 extends and an aperture 204. A second inwardly disposed array coradial with the array 192 shown in FIG. 3 is shown at inner array 206. As in the case of array 202, the inner array 206 is formed of aperture pairs. Looking to FIG. 2 and bracket 146, connectors corresponding with pivot connector 182 and connectors 194 and 196 are shown, respectively, at 208, 210, and 212.

The tri-structuring of the brackets as at 114 and 146 contributes substantially to the strength of the bracket assembly. This strength is developed in connection with the relatively wide spacing of the connectors as at 194 and 196 (FIG. 3) as well as the radial distance of those connectors from the pivot point at pivot connector 182. This permits the supporting of substantial loads on the display shelving assemblies while still permitting them to enjoy the capability for simple attitude adjustment. An important feature of the geometry exhibited by the arrays 190 and 192 of adjusting component 116 with respect to the corresponding array pairs of apertures 202 and 206 of adjusting component 112 resides in the exclusive aperture alignments which are at mandated by the assembly. In this regard, the clerk or user adjusting the attitude of the shelves can only insert connectors as at 194 and 196 through mated apertures which are at the optimum angular spacing, for example 18° or three times the basic spacing of the apertures of arrays 190 and 192. Thus, the structural integrity of the shelf assembly is assured without so much as the need for instructive material, inasmuch as the assembler or adjuster cannot employ the connectors 194 and 196 in any manner other than correctly.

Figure 7:
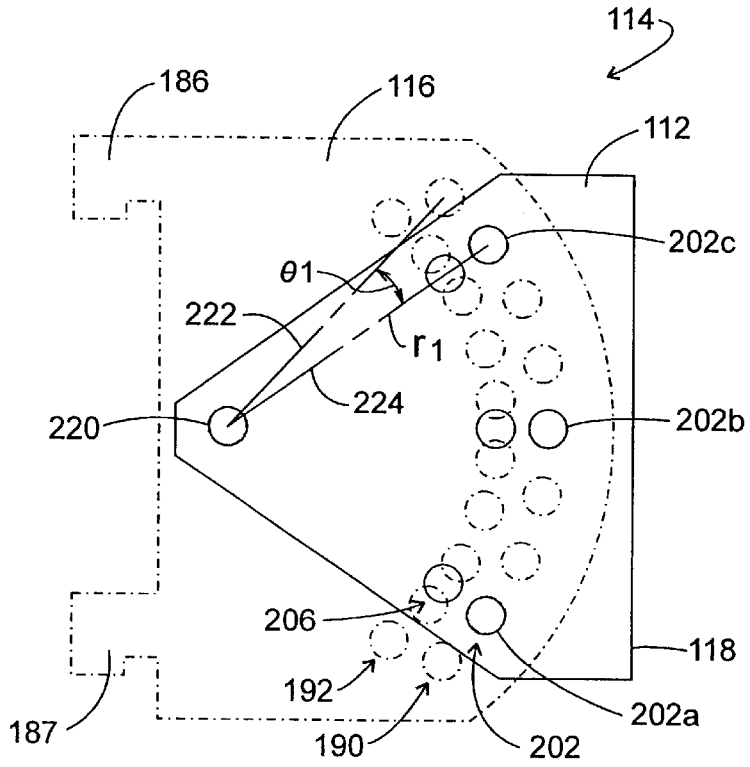
FIG. 7 is a plan view of a bracket assembly according to the invention showing a outwardly disposed adjusting component in phantom to reveal aperture alignment.
Figure 8:
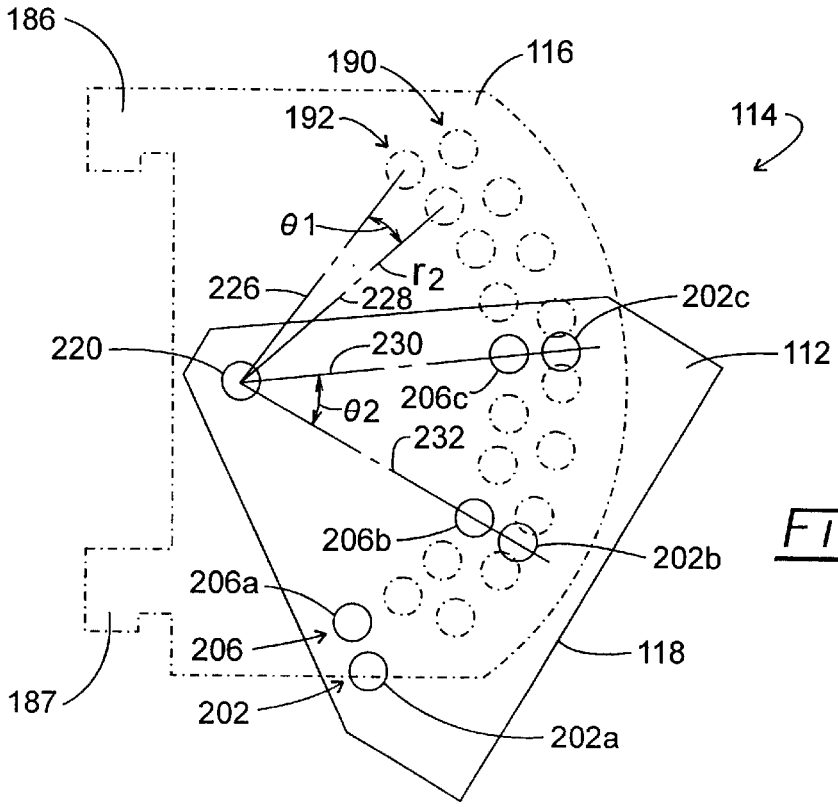
FIG. 8 is a plan view of a bracket assembly according to the invention showing outward adjusting component in phantom to illustrate aperture alignment.

Looking to FIGS. 7 and 8, this unique bracket structuring is revealed. In the figures, the inwardly-disposed adjusting component 112 is shown in juxtaposition with outwardly disposed adjusting component 116 shown in phantom. The apertures within each of the components 112 and 116 functioning to receive a pivot connector as at 182 are represented as aperture 220. In FIG. 7, it may be seen that the apertures of adjusting component 116 within the outer array 190 are regularly spaced apart along an arcuate locus and, as represented at lines 222 and 224 are positioned a radius distance from the center of pivot aperture 220 a distance $r_1$. Adjacent apertures within the array 190 and locus are shown to be symmetrically disposed about radii as at 222 and 224, which adjacent radii define an angle, $\theta_1$.

Now looking to FIG. 8, it may be observed that the locus of apertures within the array 192 of adjusting component 116 are regularly spaced apart along that locus at the radius distance $r_2$ as represented by the radius lines 226 and 228. These adjacent radii define the same angle $\theta_1$ as described in connection with array 190. However, the radii as at 228 are positioned intermediate, for example, radii 222 and 224 as shown at FIG. 7.

FIG. 8 shows that the apertures within the arcuate locii represented by arrays 202 and 206 respectively are coradial. In this regard, note that apertures 206*c* and 202*c* are coradial and symmetrical about radius line 230 extending from the center of pivot radius 220. Similarly, the next adjacent apertures 206*b* and 202*b* of respective arrays 206 and 202 are symmetrically disposed about radius line 232 extending from the center of pivot aperture 220. Radii 230 and 232 define an angle $\theta_2$ which is a multiple of the angle $\theta_1$. In a preferred embodiment, $\theta_1$ will be 6° and $\theta_2$ will be 18°.

With this geometry, aperture alignment between adjusting components 112 and 116 will occur only at the angular spacing $\theta_2$. In this regard, for the horizontal orientation configuration of the bracket assembly 114, only the apertures 202*a*, 202*b*, and 202*c* will be in alignment with corresponding apertures of the array 190 of adjusting component 116. No alignments will occur between the array 206 of component 112 and the array 192 of component 116. A similar arrangement obtains in connection with FIG. 8. In FIG. 8, the only alignment which occurs with respect to the apertures of adjusting component 112 is at apertures 206*b* and 206*c* within the inner array 206. All other aperture alignment relationships represent a blocking condition. It further may be noted that the apertures of arrays 206 and 202 are paired in that apertures 202*a* and 202*b* represent one pair and apertures 202*b* and 202*c* represent another pair. Further, with respect to array 206, apertures 206*a* and 206*b* represent a pair and apertures 206*b* and 206*c* represent a pair.

Figure 10:
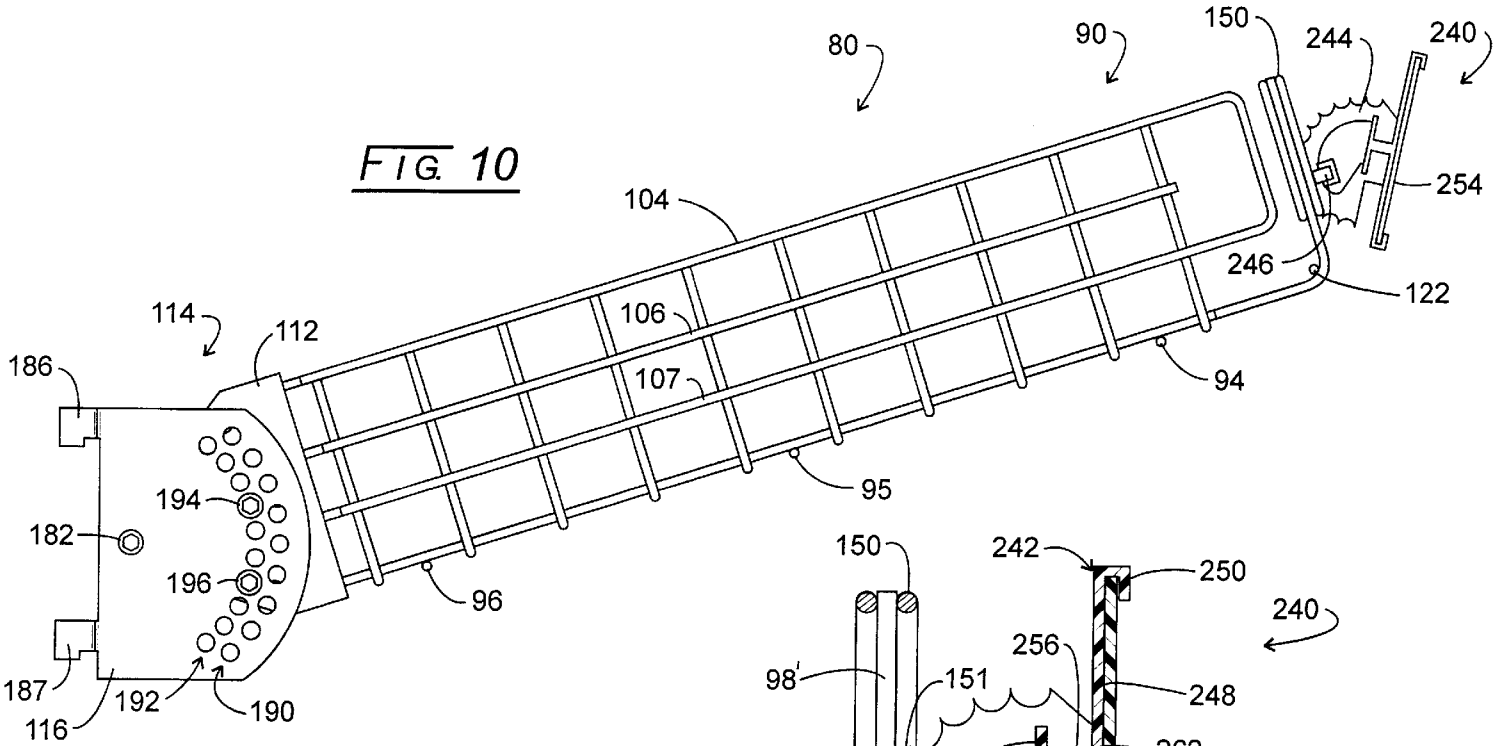
FIG. 10 is a left-side view of the apparatus of FIG. 2 showing connector positioning for an upward tilt of the shelf assembly and a downward tilt of the sign mount connected thereto.
Figure 9:
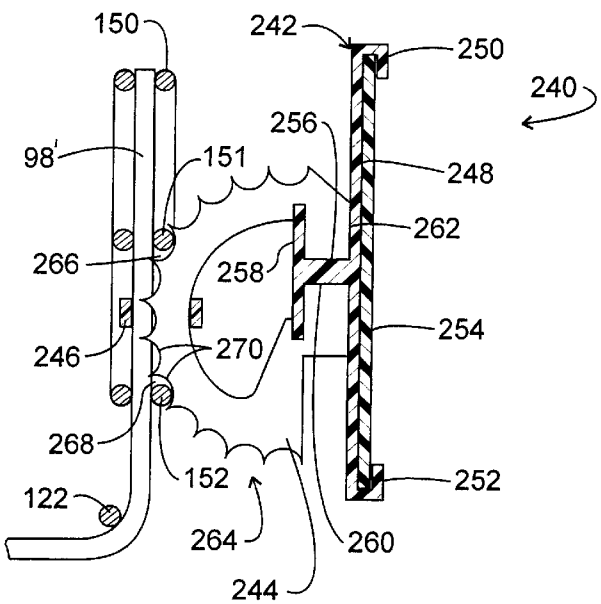
FIG. 9 is a sectional view taken through the plane 9—9 in FIG. 2.

Now considering the configuration of the sign mounts as discussed generally in connection with sign mounts 50, 60, 68, and 72 in FIG. 1, reference initially is made to FIG. 2. In the figure, a sign mount is represented generally at 240. The mount 240 includes a sign engaging surface assembly represented generally at 242 and a sequence of couplers 244. Assembly 242 is slideably engaged with the couplers 244. In turn, couplers 244 are abuttably engaged with two adjacent wall forming rods of the forward wall 86. Connection with the forward wall 86 is by conventional polymeric connector loops or ties 246. Looking additionally to FIGS. 4 and 9, the structure of the sign mount is revealed at a higher level of detail. In this regard, the sign engaging surface assembly 242 is seen to be formed having an elongate flat forward surface 248 and oppositely disposed upper and lower integrally formed channels shown, respectively, at 250 and 252. With this arrangement, an elongate sign or the like as at 254 may be slid into the assembly as illustrated. Also integrally formed with the assembly 242 is an elongate, T-shaped upstanding flanged connector 256, the flange component thereof being shown at 258. Connector 256 slides within slots as at 260 formed within each of the couplers 244. FIG. 9 shows that the couplers 244 are formed having a flat forward surface 262 and a semi-circular periphery shown generally at 264. Periphery 264 is configured having a sequence of notches with a notch shape selected for abutting engagement with the forward wall forming rods 151 and 152. In the present embodiment, these notches have a rounded periphery. Note in FIG. 9 that notch 266 engages forward wall forming rod 151 and notch 268 engages forward wall forming rod 268. An opening 270 is formed within the coupler 244 to provide for simple connection of the entire assembly to the forward wall forming rods 151 and 152. To provide this arrangement, the pitch of the notches 266 is made an even integer division of the center-to-center spacing of the rods 151 and 152. An illustration of the fastening of connector 246 is shown in FIG. 4. Looking to FIG. 10, the versatility of the sign mount 240 is demonstrated. In the figure, the shelving display assembly 80 is oriented in an upwardly tilted manner. To achieve this, the connectors 194 and 196 are inserted within two of the aligned apertures in the proper spacing for proper structural effectiveness. Only one other alignment of the apertures is available for this orientation and that is shown at aperture 206d. Note that for this elevation, the sign mount 240 has been adjusted with respect to coupler 244 and tie or connector loop 246. In this regard, the sign 254 is oriented straight ahead for readability by the customer.

Figure 11:
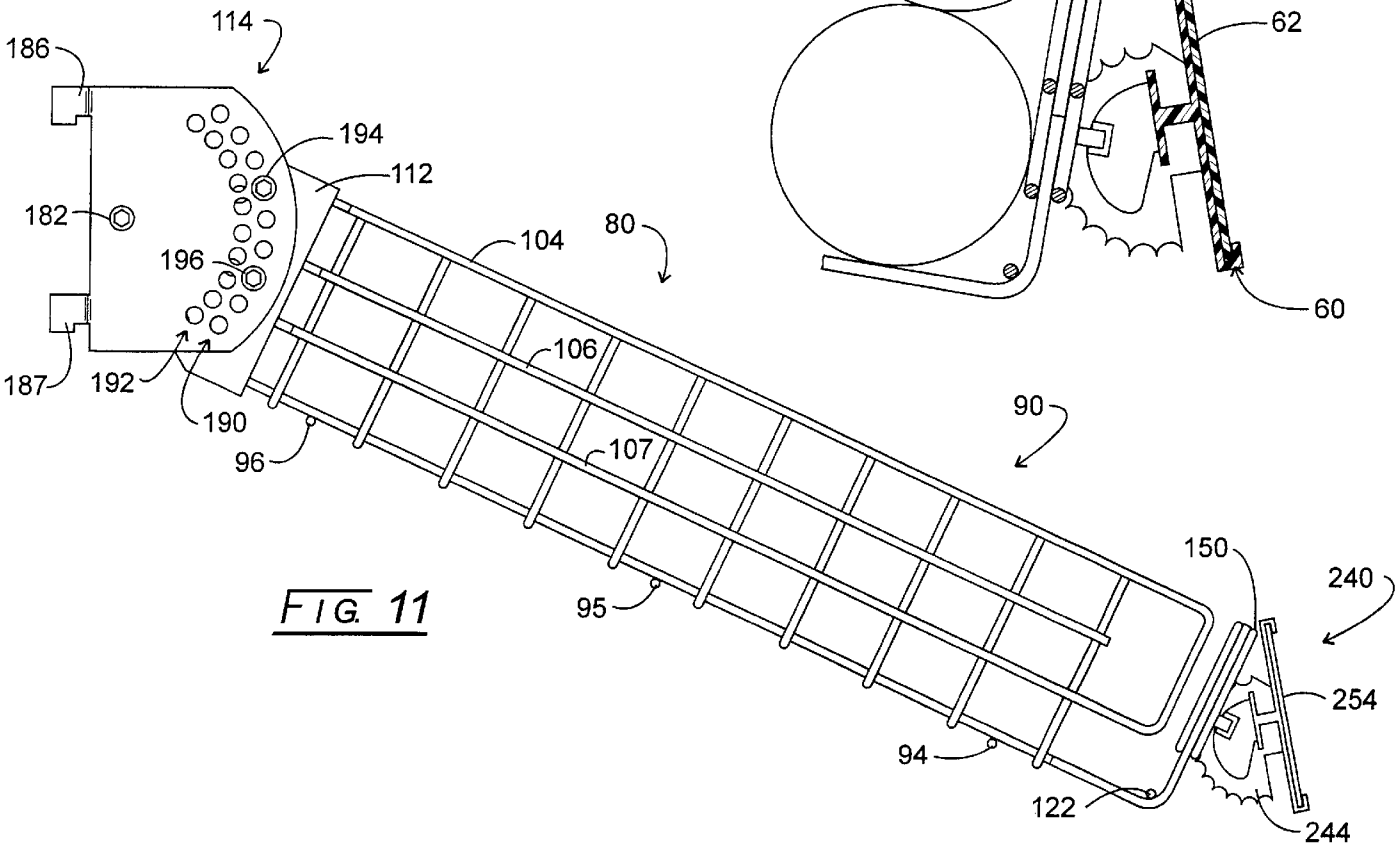
FIG. 11 is a left-side view of the display shelf assembly of FIG. 2 showing a connector positioning for a downward tilt and a sign mount upward tilt orientation.

In FIG. 11, an opposite tilt of a shelving assembly 80 is revealed. Note that the sign bracket 240 now is adjusted so as to orient the sign 254 to tilt slightly backwardly permitting ease of customer reading. Note that connectors 194 and 196 are in the outer arcuate locus of array 190. For this orientation, those aperture locations are the only ones providing for alignment and, as before, the spacing of the connectors 194 and 196 is structurally proper with respect to the tri-strut configuration of the invention.

Figure 12:
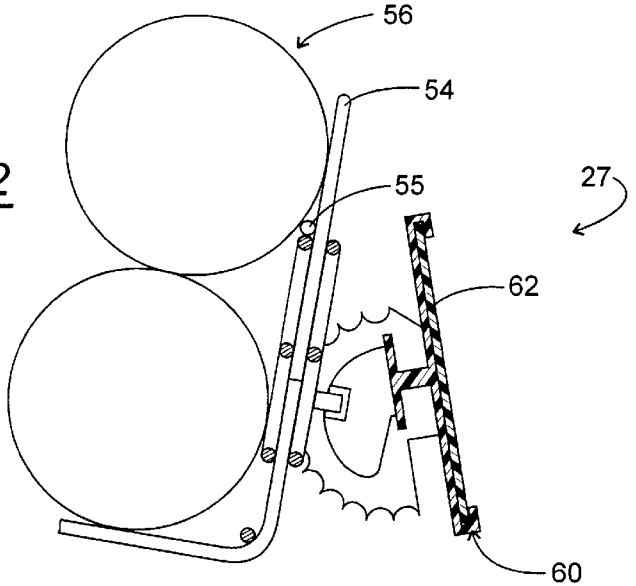
FIG. 12 is a sectional view taken through the plane 12—12 in FIG. 1.

FIG. 12 is a sectional view taken from FIG. 1 showing another upward cant of the sign 62 and its holder 60. The figure in addition to showing merchandise at a higher level of detail, shows the positioning of the merchandise retaining loop 54 within the forward receptor gap. To simplify the insertion of the assembly 54, an elongate horizontal rod 55 is welded to it rearwardly so as to rest upon the rearwardly disposed wall forming rod and simplify insertion and alignment for providing a pleasant aesthetic look to the assembly.

Figure 15:
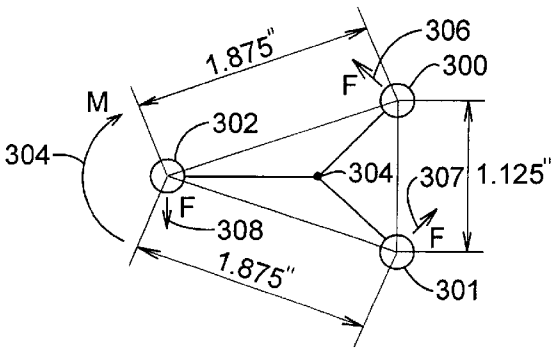
FIG. 15 is a geometric diagram utilized in describing the structural capacity of the display shelf assembly of the invention.

A structural analysis of the bracket assemblies of the invention has determined, based upon a worst case form of analysis, that the tri-strut bracket approach exhibits strengths based upon bolt steel yield strengths which exceeds the structural capacity of the notched plate or hook-type conventional connectors. The latter connectors are utilized, inasmuch as the shelf display assemblies of the invention are intended for use with conventional shelf support structures or gondolas. In carrying out this analysis, 13 gauge grade 30 steel plate (ASTM A569) having yield strength of 30 ksi (kips per square inch) was elected. Next, the investigation considered the utilization of a pivot bolt connector as described at 182 in conjunction with the same form of bolt connectors as described at 194 and 196. The analysis was made for the shelf assembly to be in a horizontal orientation as depicted in FIGS. 3 and 4, and to have an average distance from the center line of each bolt to the center line of the load which would be imposed upon the shelf of 8 inches. In this regard, the force imposed by gravity and the weight of materials on the shelf was assigned the variable, P. A second force imposed upon the bolts is one of moment. These two forces were summed. Looking to FIG. 15, a diagram showing the relative location of the bolts is presented. In this regard, the pivot bolt or connector is represented at 302 and the bolts located in the inward array 192 are represented at 300 and 301 being relatively spaced by an angular amount of 18° from the center line of pivot bolt 302. The distances between these bolts 300–302 are labeled in the figure. These distances correspond with a ¼inch diameter bolt and a bracket assembly utilized with a display shelf having peripheral dimensions of about 16 inches wide and 4 feet in length. A clockwise moment, M, as applied by the shelf load about a center of rotation 305 is represented at arrow 304 and the resultant force vectors asserted in response are represented at 306–308. The shear force due to moment may be computed as:

$$F_m = \frac{M(\text{in} - \text{lbs})}{2.67\ (\text{in})} \quad (1)$$

The shear force $F_s$ imposed by the weight of the shelf and assumed load, P, is determined as follows:

$$F_s = \frac{P}{3} \quad (2)$$

Computations determining the load capacity of the notched plates or hooks as described at 186 and 187 (FIG. 7) were based upon the noted 13 gauge 30 grade steel, and the capacity of these brackets for conventional mounting of the shelf was 140 lbs per bracket. By contrast, utilizing four grades for ¼inch bolts, the following analysis shows bracket capacity for the tri-strut three bolt system and, for comparison, the utilization of two bolts, located horizontally at a center-to-center distance apart of 1.875 inch. The following table identifies bolt steel grade, corresponding bolt capacity for that steel grade, and the force exerted upon each of the three bolts in conjunction with a load commensurate with the bolt capacity.

| | Bolt Capacity | For 3 Bolts | For 2 Bolts |
|---|---|---|---|
| $30^{ksi}$ | 588# | 176# | 123# |
| $36^{ksi}$ | 706# | 211# | 148# |
| $42^{ksi}$ | 823# | 246# | 173# |
| $50^{ksi}$ | 980# | 294# | 206# |

Tear out between holes also was investigated for a condition wherein ¼inch diameter apertures are spaced apart, periphery-to-periphery, ⅛inch and thus were spaced ⅜inch center-to-center. For 13 gauge, 30 ksi bolts noted above, the maximum load avoiding tear out was 807 lbs.

Figure 13:
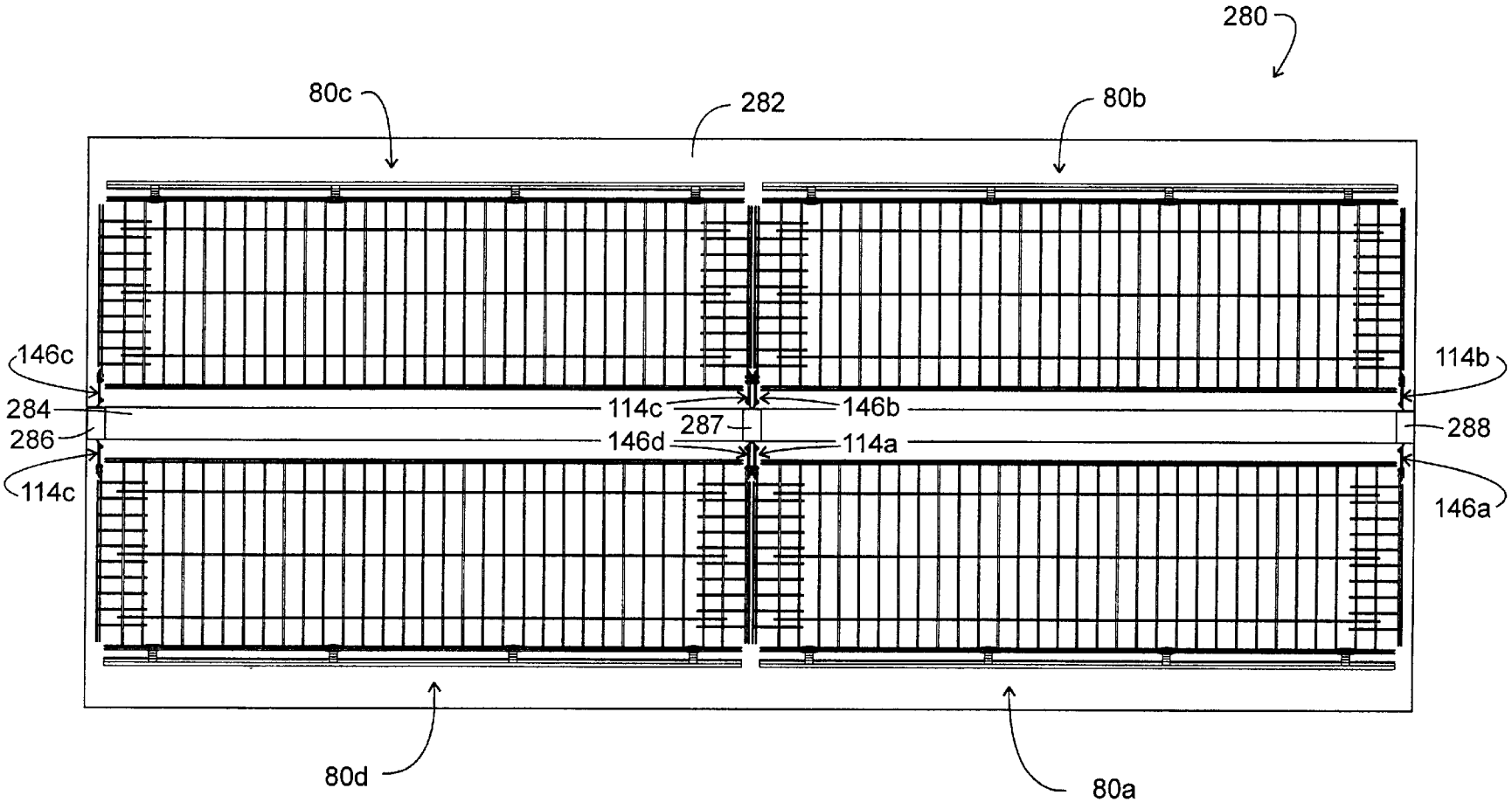
FIG. 13 is a top view of a four display shelf assembly mounting upon a shelf support.
Figure 14:
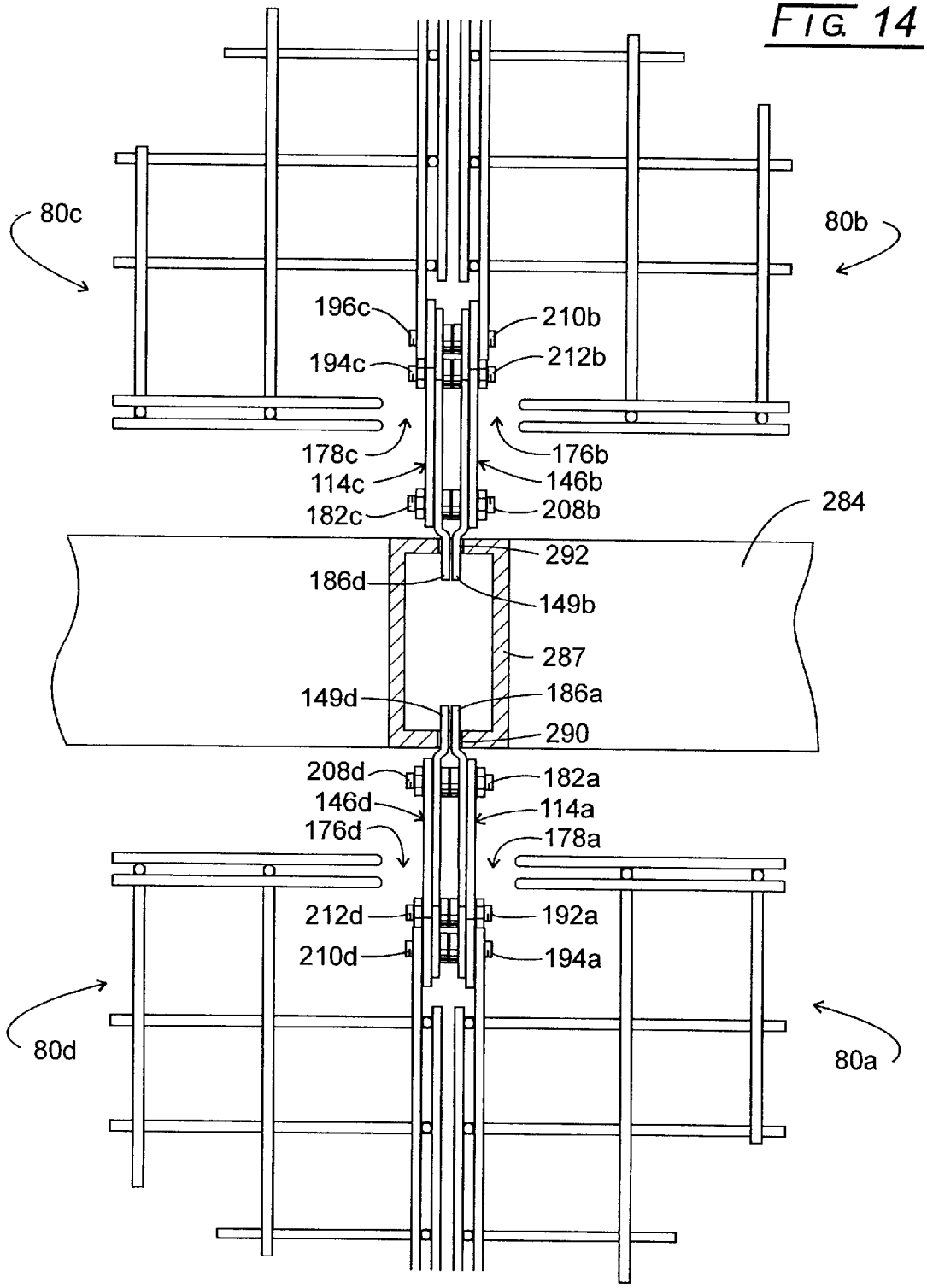
FIG. 14 is a partial sectional view showing the adjacent mounting of bracket components of the assembly of FIG. 13.

Shelf assemblies as at 80 enjoy a capability for being mounted upon preexisting shelf support structures or gondolas. In this regard, the shelves readily are manufactured in a variety of sizes and, the pivotal bracket assemblies as at 114 and 146 are configured of a flat plate structuring such that they are thin and compact, permitting the tandem mounting of the shelves. Looking to FIG. 13, a shelf support or gondola configured as an inverted T is shown generally at 280. In this regard, the support 280 includes a base 282. From the center of base 282 there extends a wall or upright 284 having three standards of rectangular configuration mounted therein as seen at 286–288. In FIG. 13, the shelf assemblies retain the numeration given in FIGS. 2 et seq. with an alphabetical suffix such that two shelves are shown in tandem at 80*a* and 80*d*, and two shelving assemblies are shown in tandem at 80*b* and 80*c*. Note that the bracket assemblies as at 146*d* and 114*a* and at 146*c* and 114*b* enjoy the capability for being closely nested to permit this desired utilization of pre-existing shelf supports. Looking additionally to FIG. 14, it may be observed that the low profile bolt heads of the connectors 182, 194, 196, 208, 210 and 212 along with the offset notch plates 149 and 186 permit the common tandem use of slots as at 290 and 292 within the standard 287.

The load carrying capacity of the shelving assembly is readily increased by increasing the thickness of the hook or notch components 186 and 187, for example to ⅛inch. When increased to that thickness, the capacity for each bracket increases to 200 lbs. Additionally, the same capacity may be realized by lengthening the width of the hooks rearwardly of their engagement with a slot, for example, to ⅝inch. Thus, even though the open front shelving and associated bracket assemblies are open and aesthetically pleasing, they are capable of sustaining substantial merchandise loadings.

Since certain changes may be made to the above system and apparatus without departing from the scope of the invention herein involved, it is intended that all matter contained in the above description or shown in the accompanying drawings shall be interpreted as illustrative and not in a limiting sense.

What is claimed is:

1. A bracket assembly mountable intermediate a vertical support and a display shelf, comprising:

a first adjusting component having a first pivot aperture, a first array of attitude defining first apertures regularly spaced apart along a first arcuate locus and first radius distance from the center of said first pivot aperture, adjacent said attitude defining first apertures being symmetrically disposed about first radii of said first arcuate locus defining a first angle;

a second adjusting component positioned in slideable adjacency with said first adjusting component, having a second pivot aperture aligned with said first pivot aperture, having a second array of pairs of second apertures positioned along a second arcuate locus located a said first radius distance from the center of said second pivot aperture, each aperture of said pair of second apertures being symmetrically disposed about second radii of said second locus defining a different second angle corresponding with a predetermined dual connector position spacing;

a first connector inserted through said first and second pivot apertures to pivotally connect said first and second adjusting components;

a second connector inserted through a said first aperture of said first array and a said second aperture of a given pair within said second array aligned with said first aperture;

a third connector inserted through a said first aperture of said first array and a said second aperture of said given pair of said second array.

2. The bracket assembly of claim 1 in which:

said first angle is about six degrees; and said second angle is about 18 degrees.

3. The bracket assembly of claim 2 in which:

each aperture of said first array of attitude defining apertures and each aperture of said second array of pairs of second apertures has a principal dimension of about one-fourth inch; and said first radius distance is within a range of about one to two and one-half inches.

4. A bracket assembly mountable intermediate a vertical support and a display shelf, comprising:

a first adjusting component having a first pivot aperture, a first array of attitude defining first apertures regularly spaced apart along a first arcuate locus and first radius distance from the center of said first pivot aperture, adjacent said attitude defining first apertures being symmetrically disposed about first radii of said first arcuate locus defining a first angle;

a second adjusting component positioned in slideable adjacency with said first adjusting component, having a second pivot aperture aligned with said first pivot aperture, having a second array of pairs of second apertures positioned along a second arcuate locus located a said first radius distance from the center of said second pivot aperture, each aperture of said pair of second apertures being symmetrically disposed about second radii of said second locus defining a second angle corresponding with a predetermined dual connector position spacing;

a first connector inserted through said first and second pivot apertures to pivotally connect said first and second adjusting components;

a second connector inserted through a said first aperture of said first array and a said second aperture of a given pair within said second array aligned with said first aperture;

a third connector inserted through a said first aperture of said first array and a said second aperture of said given pair of said second array;

said first adjusting component includes a third array of attitude defining third apertures regularly spaced apart along a third arcuate locus positioned a second radius distance of value less than said first radius distance from the center of said first pivot aperture, adjacent said attitude defining third apertures being symmetrically disposed about third radii of said third arcuate locus located intermediate said first radii and defining said first angle;

said second adjusting component includes a fourth array of pairs of fourth apertures positioned along a fourth arcuate locus, located a said second radius distance from the center of said second pivot aperture and disposed co-radially with said pairs of second apertures;

said second connector is through a said third attitude defining aperture of said third array and a fourth aperture of a given pair within said fourth array aligned with said third attitude defining aperture; and said third connector is through a said third attitude defining aperture of said third array and a said fourth aperture of said given pair of said fourth array.

5. The bracket assembly of claim 4 in which:

said first angle is about six degrees; and said second angle is about 18 degrees.

6. The bracket assembly of claim 4 in which:

each aperture of said first array of attitude defining first apertures, said third array of attitude defining third apertures, said second array of pairs of second apertures, and said fourth array of pairs of fourth apertures have a principal dimension of about one-fourth inch;

said first radius distance is within a range of about one to two and one-half inches; and said second radius distance is within a range of about one to two inches.

7. The bracket assembly of claim 4 in which:

said first adjusting component is configured having spaced apart notches for accessible insertion within slots formed in said vertical supports, and is formed of sheet steel having a thickness within a range of about 1/16 inch to 1/8inch.

* * * * *